US005117911A

United States Patent [19]

Navarette et al.

[11] Patent Number: 5,117,911

[45] Date of Patent: Jun. 2, 1992

[54] SHOCK ATTENUATING APPARATUS AND METHOD

[75] Inventors: Mike Navarette; Jerry L. Walker, both of Ft. Worth, Tex.

[73] Assignee: Jet Research Center, Inc., Alvarado, Tex.

[21] Appl. No.: 686,220

[22] Filed: Apr. 16, 1991

[51] Int. Cl.[5] ..... E21B 29/02; E21B 43/263

[52] U.S. Cl. ..... 166/299; 166/63; 166/242; 166/297

[58] Field of Search ..... 166/242, 55, 55.1, 297, 166/63, 299; 175/320, 325

[56] References Cited

U.S. PATENT DOCUMENTS

| | | | |
|---|---|---|---|
| 2,810,440 | 10/1957 | Kenneday et al. | 166/242 X |
| 3,163,112 | 12/1964 | Rhea | 166/297 X |
| 3,274,798 | 9/1966 | Wiggins, Jr. | 175/320 X |
| 3,709,294 | 1/1973 | Kilgore | 166/242 X |
| 4,378,844 | 4/1983 | Parrish et al. | 166/55.1 X |
| 4,628,995 | 12/1986 | Young et al. | 166/242 X |
| 4,735,264 | 4/1988 | Burris, II et al. | 166/242 |

*Primary Examiner*—Stephen J. Novosad

*Attorney, Agent, or Firm*—Robert A. Kent; E. Harry Gilbert, III

[57] ABSTRACT

An apparatus attenuates a shock, such as an impact load from an explosion, by undergoing plastic deformation and by serially dissipating energy from a plurality of surfaces. In a particular embodiment, the plastic deformation and serial energy dissipation occur in and from a hollow unitary body having a cylindrical wall in which are defined a plurality of longitudinally spaced circumferential grooves. A method of attenuating shock from an explosion in an oil gas well comprises: lowering into the well an explosive connected to a shock attenuating member; detonating the explosive whereby an impact load with a shock wave is generated; and collapsing without severing the member in response to the impact load and dissipating energy of the shock wave from a plurality of surfaces of the member so that the shock wave is attenuated along the member.

7 Claims, 1 Drawing Sheet

SHOCK ATTENUATING APPARATUS AND METHOD

BACKGROUND OF THE INVENTION

This invention relates generally to a shock attenuating apparatus and a related shock attenuating method. The invention relates more particularly, but not by way of limitation, to a mandrel and a method for attenuating an explosion-created impact load and its resultant shock wave in a tool string within a well.

When a collection of components are strung together, sometimes one section of components needs to be buffered from another section of components so that shock forces from one section do not travel into the other section with a sufficient intensity to cause damage. By way of example, in an oil or gas well, casing or tubing located in the well sometimes needs to be cut. One way of doing this is to lower a tubing or casing cutter containing explosives into the well to the point at which the cut is to be made. The explosive is then detonated. Although the force from the explosion is intended to be directed towards the tubing or casing, an impact load from the explosion tends to lift the tool string. Furthermore, the impact load includes one or more shock waves which are conducted up the tool string by which the cutter is lowered into the well. A typical tool string also contains working components such as a casing collar locator. These working components can be sensitive to, and damaged by, the impact load (particularly its shock wave) which is produced by the cutter explosion.

To try to attenuate an impact load shock wave before it reaches other components, long sections of pipe or tubing have been connected into the tool string between the cutter and the other components. It is intended that the shock wave be damped by the resistance of the long pipe section.

Although such long pipe section helps to attenuate the shock, we believe that better shock attenuation can be obtained. Additionally, a long pipe section is cumbersome and it adds to the length and weight of the tool string. Therefore, there is the need for an improved apparatus and method for attenuating shock such as is created by the explosion of a tubing or casing cutter downhole in an oil or ga well.

SUMMARY OF THE INVENTION

The present invention overcomes the above-noted and other shortcomings of the prior art by providing a novel and improved shock attenuating apparatus and method. The apparatus of the present invention is relatively short and compact, yet it provides improved shock attenuation. The apparatus is rigid so that a load connected to the apparatus can be readily moved up and down within a well, for example. The apparatus is also strong enough to withstand hydrostatic pressure of fluids within the well, and yet it yields to an explosive force to damp or attenuate the impact load, or shock, generated by the explosion.

More particularly, the present invention provides an apparatus for attenuating a shock in a tool string within a well. The apparatus comprises a body inextensible under tensile loading, which body includes: means for connecting the body into the tool string; and means, connected to the connecting means, for undergoing plastic deformation in response to an explosive impact load and for serially dissipating energy of a shock wave propagated in the body in response to the explosive impact load. In a preferred embodiment, the apparatus is a shock attenuating mandrel comprising a hollow unitary body having a cylindrical wall in which are defined a plurality of longitudinally spaced circumferential grooves.

The present invention also provides a method of attenuating shock from an explosion in a well. This method comprises: lowering into the well an explosive connected to a shock attenuating member; detonating the explosive whereby an impact load with a shock wave is generated; and collapsing without severing the member in response to the impact load and dissipating energy of the shock wave from a plurality of surfaces of the member so that the shock wave is attenuated along the member.

Therefore, from the foregoing, it is a general object of the present invention to provide a novel and improved shock attenuating apparatus and method. Other and further objects, features and advantages of the present invention w 11 be readily apparent to those skilled in the art when the following description of the preferred embodiment is read in conjunction with the accompanying drawings.

DETAILED DESCRIPTION OF PREFERRED EMBODIMENT

Figure 1:
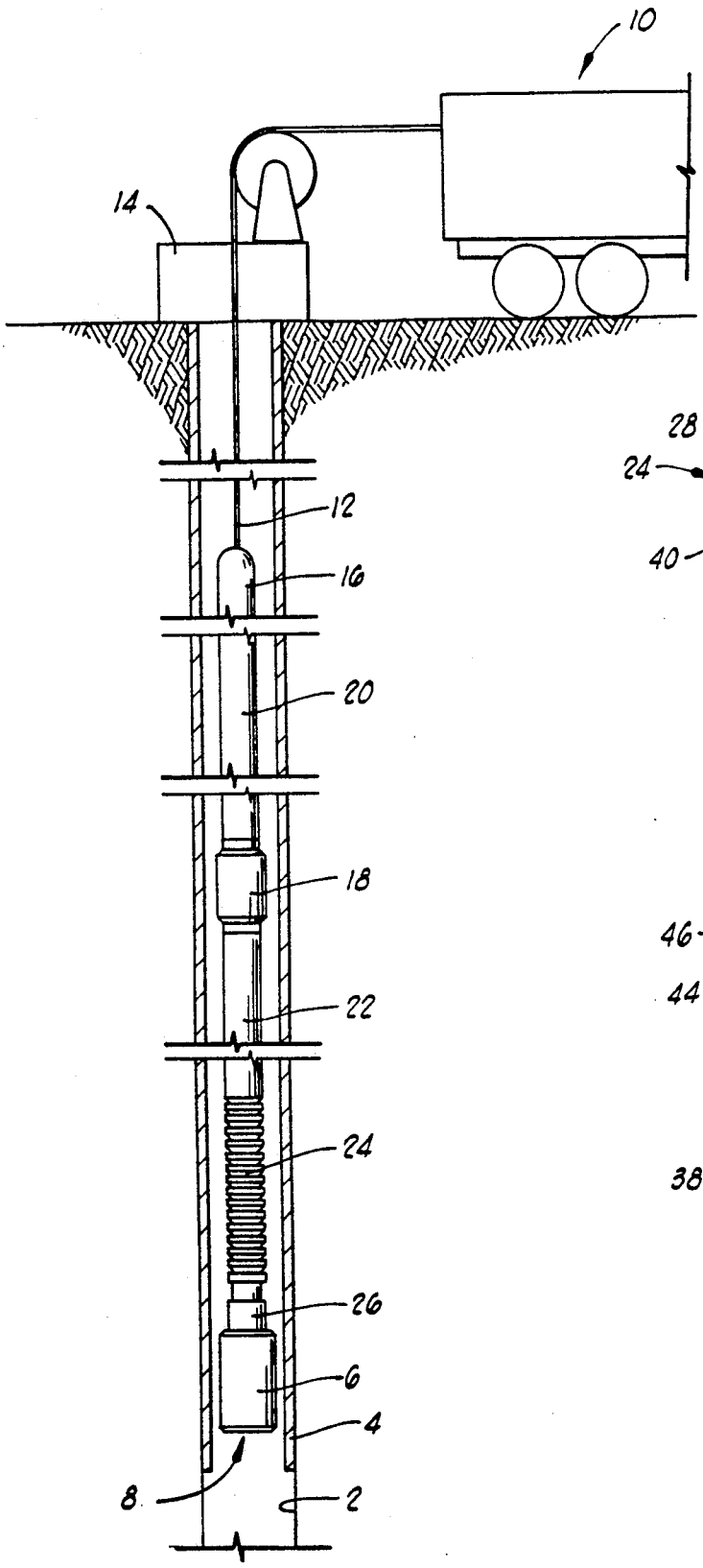
FIG. 1 is a schematic illustration of a tool string lowered into an oil or gas well, which tool string includes a shock attenuating apparatus of the present invention.

An oil or gas well environment in which the preferred embodiment of the present invention is particularly adapted to be used is schematically illustrated in FIG. 1. A well 2 is partially lined with a casing 4 in a manner as known in the art. A lower portion of the casing 4 is to be cut by a casing cutter 6.

The casing cutter 6 forms part of a tool string 8 which in the illustrated embodiment is particularly adapted to be lowered on a conventional wire line system 10 that includes a wire line 12 passing through conventional well head closure 14. The tool string B includes a wire line cable head adapter 16 for connecting with the wire line 12. Connected to the adapter 16 in either order or in a combined manner are a casing collar locator 18 and a sinker bar 20. A firing head 22 is connected to the foregoing assembly and to a shock attenuating apparatus 24. A detonator adapter 26 is connected to the apparatus 24 and the casing cutter 6. Other known types of tool strings and components thereof can be used in conjunction with the apparatus 24 of the present invention.

The casing cutter 6 includes one or more charges containing explosive in a suitable quantity (e.g., 0.1 pound). When detonated, the explosive produces a radial jet to cut the casing 4 adjacent the location of the cutter 6. The explosion also generates an impact load which produces a shock wave which travels up the tool string 8. The shock wave is typically of sufficient intensity that it can damage the tool string 8 or its components if the shock wave is not attenuated. The explosive impact load can also be intense enough to move the string vertically within the well. To avoid or limit such damage and reaction, the present invention of the shock attenuating apparatus 24 is used.

Only the shock attenuating apparatus 24 will be further described herein because the other components of the tool string 8 and the wire line system 10 are conventional and well known in the art.

Figure 2:
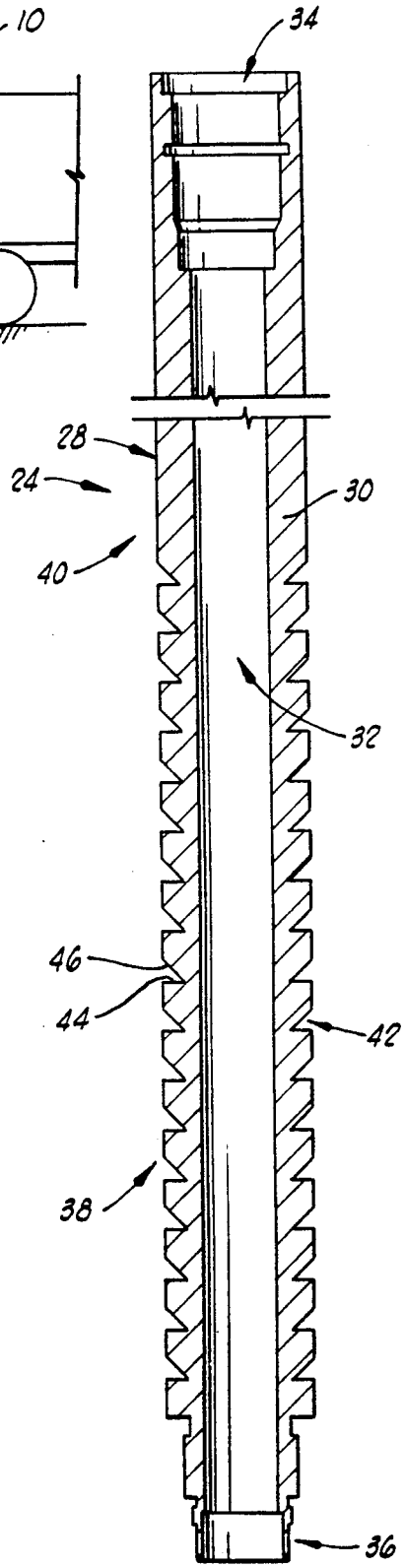
FIG. 2 is a sectional view of a shock attenuating mandrel of the preferred embodiment of the present invention.

The preferred embodiment of the apparatus 24 is a shock attenuating mandrel illustrated in FIG. 2. The mandrel 24 of the preferred embodiment comprises a rigid body 28 which is inextensible under tensile loading. In the environment illustrated in FIG. 1, tensile loading results from the detonator adapter 26 and the casing cutter 6 being hung from the body 28. Because of its rigidity or inextensibility, the body 28 does not vertically yield like a spring. This rigidity permits the body 28 and its load to follow the up and down movements of the tool string 8.

Although the body 28 is rigid, it does have an elastic limit which is exceeded by the shock of a sufficiently intense impact load generated by the explosion of the cutter 6. When the elastic limit is exceeded by the explosive impact load, the body 28 undergoes plastic deformation. This helps attenuate the shock. After plastic deformation of the body 28, the body retains its deformed shape so that anything which remains connected below it can be retrieved when the tool string 8 is pulled out of the well 2. The elastic limit can be predetermined and the body 28 designed for implementing the elastic limit using equations known in the art. In the preferred embodiment, the body is made of aluminum, but other suitable materials can be used.

The body 28 is defined by a wall 30 which is cylindrical in the preferred embodiment. Other shapes can be used. The wall 30 is annular in transverse cross section so that an axial hollow 32 is defined throughout the length of the body 28. The wall 30 is continuous so that the body 28 of the preferred embodiment is unitary (i.e., a single piece).

The wall 30 terminates at two ends. At an upper end there is defined a threaded box coupling 34, and at the lower end there is defined a threaded pin coupling 36. The box and pin couplings 34, 36 define means for connecting the body 28 into the tool string 8 when used in the illustrated environment.

In between the two ends of the wall, there is a longitudinal section 38 having a serrated configuration in the cross section shown in FIG. 2. The section 38 of the illustrated embodiment is adjacent the lower pin end. An upper section 40 of the wall extends from the section 38 through the box end. The section 40 does not have a serrated configuration in the FIG. 2 embodiment.

The serrated section 38 is the principal portion of the body 28 which undergoes plastic deformation in response to the impact load from the explosion of the cutter 6. The serrated section 38 also serially dissipates energy of the one or more shock waves propagated in the body 28 in response to the explosion.

The serrated section 38 is defined by a plurality of indentations 42 formed in the wall 30. In the preferred embodiment the indentations 42 are longitudinally spaced circumferential grooves machined into the exterior of the wall of aluminum defining the body 28. More particularly, each indentation 42 is defined by a respective annular surface 44 and an angled surface 46. The annular surface 44 extends radially inward from the exterior surface of the wall 30, and the angled surface 46 extends inward from the exterior surface of the wall 30 into intersection with the respective annular surface 44. In the preferred embodiment each angled surface 46 has a frusto-conical shape.

In a specific design, each surface 46 intersects its respective surface 44 at a 45° included angle. Consecutive annular surfaces 44 are longitudinally spaced 0.50 inch from each other. Intermediate these surfaces are the respective groove and a portion of the cylindrical exterior surface of the wall 30. The intersection between respective surfaces 44, 46 has a 0.02 inch radius, and this intersection has a circular configuration with a 1.04 inch diameter for a 1.50 inch diameter stock of aluminum wall 30. The diameter of the inner hollow 3 through the section 38 for this particular design is 0.750 inch.

To use the mandrel 24 to attenuate the effect in the tool string 8 of the impact load from an explosion of the cutter 6 in the well 2, the mandrel is connected into the tool string 8 as is illustrated in FIG. 1. The tool string 8, containing the interconnected explosive cutter 6 and the shock attenuating member 24, is lowered into the well on the wire line 12 in a conventional manner. When the casing cutter 6 is adjacent the locus within the well 2 where the cut is to be made, the explosive is detonated in a conventional manner, whereby an impact load with resulting shock wave is generated. A cutting force is also generated, but it is the impact load on the string 8 which is of particular interest with regard to the present invention.

In the operation of the present invention, this explosive impact load is attenuated by collapsing, without severing, the mandrel 24. This absorbs or dissipates the energy which would otherwise act to lift the string 8. The impact load is also attenuated by dissipating energy of the impact load shock wave. This energy is dissipated from a plurality of surfaces of the mandrel 24 so that the shock wave of the impact load is attenuated along the mandrel 24. In the preferred embodiment, the shock wave propagates through the wall 30, but when the shock wave encounters each surface 44, energy is lost through the interface between the surface 44 and the surrounding fluid found in the well 2. Because the shock wave traveling through the wall 30 encounters each annular surface 44 in series as the shock wave travels up the body 28, the energy dissipation is also serial. That is, incremental attenuation of the shock wave occurs along the length of the serrated section 38.

The collapsing of the mandrel 24 also occurs primarily within the serrated section 38. The collapsing results from one or more of the indentations 42 collapsing radially inwardly with the respective surfaces 44, 46 moving towards each other. This collapsing produces the plastic deformation. The elastic limit at which the collapsing or plastic deformation occurs is determined in a known manner based on the material of the wall 30 and the design of the indentations 42.

Thus, the impact load or shock generated by the explosion of the casing cutter 6 is dissipated both by the collapsing or plastic deformation of the serrated section 38 and by the dissipation of energy from the annular surfaces 44 of the section 38.

Accordingly, the present invention is well adapted to carry out the objects and attain the ends and advantages mentioned above as well as those inherent therein. While a preferred embodiment of the invention has been described for the purpose of this disclosure, changes in the construction and arrangement of parts and the performance of steps can be made by those skilled in the art, which changes are encompassed within the spirit of this invention as defined by the appended claims.

What is claimed is:

1. An apparatus for attenuating a shock in a tool string within a well, comprising a body in extensible under tensile loading, said body including:

means for connecting said body into the tool string; and means, connected to said connecting means, for undergoing plastic deformation in response to an explosive impact load and for serially dissipating energy of a shock wave propagated in said body in response to said explosive impact load wherein said means for undergoing deformation and dissipating energy includes a wall of said body wherein a plurality of indentations are defined.

2. An apparatus as defined in claim 1, wherein each of said indentations is defined by a respective annular surface of said body and a respective frusto-conical surface of said body extending from said respective annular surface.

3. An apparatus as defined in claim 1, wherein said wall is cylindrical and each of said indentations is a circumferential groove around the exterior of said wall.

4. An apparatus for attenuating a shock in a tool string within a well, comprising a body inextensible under tensile loading, said body including:

means for connecting said body into the tool string; and means, connected to said connecting means, for undergoing plastic deformation in response to an explosive impact load and for serially dissipating energy of a shock wave propagated in said body in response to said explosive impact load, wherein said body is a cylindrical wall having threaded box and pin ends defining said connecting means and further having, in between said ends, a serrated longitudinal section defining said means for undergoing plastic deformation and for serially dissipating energy.

5. An apparatus as defined in claim 4, wherein said serrated longitudinal section of said wall includes:

a plurality of longitudinally spaced annular surfaces extending radially inward from an exterior surface of said wall; and a plurality of angled surfaces, each of said angled surfaces extending inward from the exterior surface of said wall into intersection with a respective one of said annular surfaces.

6. A shock attenuating mandrel, comprising a hollow unitary body having a cylindrical wall in which are defined a plurality of longitudinally spaced circumferential grooves, wherein said grooves are defined by a plurality of longitudinally spaced annular surfaces extending radially inward from an exterior surface of said wall and a plurality of angled surfaces, each of said angled surfaces extending inward from the exterior surface of said wall into intersection with a respective one of said annular surfaces.

7. A method of attenuating shock from an explosion in a well, comprising:

lowering into the well an explosive connected to a shock attenuating member;

detonating the explosive whereby an impact load with a shock wave is generated; and collapsing without severing the member in response to the impact load and dissipating energy of the shock wave from a plurality of surfaces of the member so that the shock wave is attenuated along the member.

* * * * *